US008303297B2

(12) United States Patent
Tompkins et al.

(10) Patent No.: US 8,303,297 B2
(45) Date of Patent: Nov. 6, 2012

(54) METHOD AND APPARATUS FOR CONTROLLING COMBUSTION IN A BURNER

(75) Inventors: Gene Tompkins, Arkansas City, KS (US); Alan Brennan, Winfield, KS (US); Jerry Kunkle, Arkansas City, KS (US)

(73) Assignee: Webster Engineering & Manufacturing Co., LLC, Winfield, KS (US)

( * ) Notice: Subject to any disclaimer, the term of this patent is extended or adjusted under 35 U.S.C. 154(b) by 626 days.

(21) Appl. No.: 11/981,222

(22) Filed: Oct. 31, 2007

(65) Prior Publication Data

US 2009/0111065 A1 Apr. 30, 2009

(51) Int. Cl.
*F23N 1/02* (2006.01)

(52) U.S. Cl. ..... 431/90; 431/12; 431/89

(58) Field of Classification Search ..... 431/90, 431/9, 89, 12; 122/13.01, 14.1, 14.21, 14.31
See application file for complete search history.

(56) References Cited

U.S. PATENT DOCUMENTS 4,645,450 A * 2/1987 West ..... 431/12
4,770,627 A * 9/1988 Yoshino ..... 431/18
5,122,053 A * 6/1992 Basten ..... 431/12
5,158,446 A 10/1992 Hall ..... 431/20
5,472,050 A * 12/1995 Rhoten et al. ..... 166/250.1
5,634,786 A * 6/1997 Tillander ..... 431/90
6,035,810 A * 3/2000 Movassaghi ..... 122/24
6,213,758 B1 * 4/2001 Tesar et al. ..... 431/12
6,276,440 B1 * 8/2001 Kaga et al. ..... 165/96
6,571,817 B1 * 6/2003 Bohan, Jr. ..... 137/88
6,694,926 B2 2/2004 Baese et al. ..... 122/14.2
6,840,198 B2 1/2005 Kang et al. ..... 122/5.51
6,984,122 B2 * 1/2006 Sullivan et al. ..... 431/89
7,279,857 B2 * 10/2007 Babb et al. ..... 318/400.23
7,280,793 B2 * 10/2007 Zess et al. ..... 399/323
2001/0051321 A1 * 12/2001 La Fontaine ..... 431/12
2005/0158172 A1 * 7/2005 Snyder et al. ..... 415/206
2006/0059921 A1 * 3/2006 Hao et al. ..... 62/6
2006/0150925 A1 7/2006 Akkala et al. ..... 122/14.1

* cited by examiner

*Primary Examiner* — Alfred Basichas
(74) *Attorney, Agent, or Firm* — Whitaker Chalk Swindle & Schwartz PLLC; Stephen S. Mosher

(57) ABSTRACT

A method and apparatus that applies corrections to the mass flow rate of combustion air into a gas or oil-fired, forced-draft burner, and thus provides for correcting the air-fuel ratio, by directly measuring the combustion air temperature and/or the barometric pressure of the combustion air, and using these measurements to develop a fan speed drive signal that corrects the volume of air inlet to the burner system without the use of the complex and expensive fully metered control systems, or elaborate feedback systems, or systems that require real-time combustion analysis, and the like.

10 Claims, 2 Drawing Sheets

METHOD AND APPARATUS FOR CONTROLLING COMBUSTION IN A BURNER

BACKGROUND OF THE INVENTION

1. Field of the Invention

The present invention generally relates to machine controls and more particularly to the control of combustion in a burner for heating water or other substances by controlling air flow into the burner responsive to changes in physical parameters affecting air and or fuel density.

2. Background and Description of the Prior Art

Burners for machine systems such as water heater boilers for example, generally mix a fuel in gas or liquid form with air to provide a source of heat. Efficient combustion occurs when (a) the ratio of the mass of air to the mass of fuel is held within a small range of values centered on approximately 18-to-1, and (b) sufficient air is mixed with the fuel to ensure combustion of all of the fuel plus some small amount of "excess air." Generally, sufficient air is provided when the amount of excess air is approximately 15%, which corresponds with an air-fuel ratio of approximately 18-to-1. If the excess air exceeds about 15%, some of the heat produced is consumed heating the excess air and is thus not available for heating the water in the boiler. Thus, it is important to maintain a stable and relatively low excess air level.

However, unless the burner is operated in an atmosphere of substantially constant air temperature and barometric pressure, the setting of operating controls for the burner is at best only a rough approximation to an optimum level for efficient combustion over normal variations in temperature. Thus, these settings require a substantial offset to compensate for changes in the air temperature. The result is that excess air values often exceed the 15% figure by a wide margin, to as much as 30% or more, when the combustion air temperature changes, placing an extra burden upon the heat energy produced upon the burner. Such a situation may occur, for example, when the temperature may vary as much as 20° F. to 30° F. or more over a 24 hour period, or as much as 80° F. to 100° F. through seasonal variations. To compensate for such variations, some burner efficiency, and some fuel consumption, is traded off for ensuring complete combustion at all times to minimize unburned fuel and emissions.

Most burners built today use a "Volume Control" system to control the flow of fuel and air. On gas fueled burners, the fuel pressure is controlled with a regulating valve, and the correct flow rate is obtained with an orifice. The orifice may be fixed for "On-Off" firing or it may be a control valve (like a butterfly valve) which can be opened and closed to allow more or less fuel in. The combustion air is controlled in a similar manner, using a fixed orifice for "On-Off" air flow control and an air damper for modulating air control.

Conventional volume control systems for water heater burners are subject to errors in the control of the air and fuel rate because the correct proportions of air and fuel are defined by the mass flow not volume flow. For each pound of natural gas provided to the burner, a corresponding quantity of air is required (about 18 pounds of air). According to the gas laws, the mass provided by a given volume of air can vary according to its temperature and the barometric pressure. Thus, the ratio of mass to volume is defined as the density of a gas, and can be defined mathematically for our purposes as, $$\text{Actual Density}=(\text{Std. density})\times(\text{absolute pressure}/\text{std pressure})\times(\text{std temperature}/\text{absolute temperature}), \quad \{\text{Eqn. 1}\}$$

where:

Density=weight of gas per unit volume of gas (lb/ft$^3$ of gas at the stated pressure and temperature), and Std. density=density of the gas at standard conditions (0.0765 lb/ft$^3$ for air at 60° F. and 29.92" Hg), where:

Absolute pressure=gauge pressure+barometric pressure of the current condition;

Std pressure=standard pressure, 29.92" Hg (barometric pressure);

Std temperature=standard temperature, 60° F.; and

Absolute temperature=460+the temperature in ° F. of the gas.

These changes in density can result in large changes in the air-fuel ratio and the excess air of the burner combustion. For example, a difference of a combustion air temperature change from 120° F. on a hot afternoon to 40° F. on a cool morning will result in an increase in excess air of about 14%. This means that the burner is passing through 14% more excess air at 40° F. than at 120° F., and heating this air from 40° F. to the stack temperature (which is often around 500° F.) requires proportionately more fuel. This significantly reduces the efficiency of the boiler-burner package, making it more expensive to operate.

Oil fueled systems are not subject to the same density variations as a gas fuel system, because the liquid oil has a very small change in properties with temperature and pressure. For oil firing, the temperature generally must be controlled to maintain good atomization. Moreover, the oil pressures are so much higher than atmospheric pressure that the change in atmospheric (i.e., barometric) pressure has little effect. The concept of density change can be applied to oil flow, but it offers a much smaller improvement.

The impact of temperature and pressure variation is seen in the limitations and alternate control methods and systems used by burner manufacturers. Following are listed some typical methods that burner manufacturers use to solve these problems.

a. The simplest means of handling this is to allow for higher rates of excess air in the burner, and especially on cold days, set up the burner with very high excess air rates so that when it gets hot, there is enough air available to completely burn the fuel. This may typically be described in the service manual as a basic setup requirement.
b. Require the room to be heated to minimize combustion air temperature variations.
c. Perform more frequent burner tune ups, especially on a seasonal basis, to correct for some of the variation in the combustion air temperature.
d. Add an Oxygen Trim system to compensate for these changes by measuring the excess air and adjusting the fuel or air flow rate to obtain a constant excess air level.
e. Applications with outdoor installation or ducted outside air are generally required to have this air heated to reduce the variation in temperature to minimize combustion stability problems.
f. Add a fully metered control system. This system measures the mass flow of air and fuel. It is a very expensive option and rarely used.

The concept of a "Fully Metered System" or "Full Metered Cross Limited Control System," as described in (f) above, is not new. These systems have been used in the industry for many years. However, such systems are very complex and expensive, and only used in a very small number of special applications where the added performance justifies the cost and complexity.

Therefore, substantial industry-wide savings could be realized if a simple, low cost system or method were available that offers the control and efficiency of a fully metered system without the complexity and cost, and which is simple, reliable, and can be installed without major modifications to the burner and/or the structure of the water heater or other heating system. Such a system would provide a practical and economical alternative means of improving the efficiency of countless water heating and other types of heating systems in use.

SUMMARY OF THE INVENTION

Accordingly, an advance in the state of the art is disclosed that applies corrections to the mass flow rate of combustion air into a forced-draft burner for a water heater or other heating system, and thus the air-fuel ratio, by directly measuring the combustion air temperature and/or the barometric pressure of the combustion air, and using these measurements to develop a fan speed drive signal that corrects the volume of air inlet to the burner without the use of the complex and expensive fully metered control systems, or elaborate feedback systems, or systems that require real-time combustion analysis, and the like.

In one embodiment, an apparatus for controlling air flow into a burner responsive to parameter variations affecting air density is disclosed comprising: a fan motor for driving an air inlet fan of the oil fueled burner; a barometric pressure sensor for providing a first indicator signal to a controller; a combustion air temperature sensor for providing a second indicator signal to the controller; and a controller for receiving the first and second indicator signals at respective first and second inputs and processing them according to a predetermined relationship to provide a fan speed drive signal from a controller output coupled to the fan motor. In one aspect of this embodiment the controller includes a PLC and a variable frequency drive system. In another embodiment, the controller includes a PLC and a variable DC voltage drive system.

In another embodiment, a method of combustion control in a burner is disclosed comprising the step of processing both a first signal corresponding to an absolute barometric pressure measurement and a second signal corresponding to a combustion air temperature measurement in a controller to generate a variable frequency fan speed drive signal for coupling to an AC motor, or a variable amplitude fan speed drive signal for coupling to a DC motor, for driving an air inlet fan of the burner. In one aspect of this embodiment, the method regulates the fan speed responsive to changes in the first and second signals to vary the air flow volume into the burner, such that the fan speed varies inversely with changes in absolute barometric pressure and directly with changes in the combustion air temperature.

In another embodiment an apparatus for controlling air flow into a burner responsive to parameter variations affecting air density is disclosed comprising: a fan motor for driving an air inlet fan of the burner; a barometric pressure sensor for providing an electrical signal proportional to air density in the vicinity of the burner to a controller; and a controller for receiving the electrical signal at a control input thereof and processing it according to a predetermined relationship to provide a fan speed drive signal from a controller output to the fan motor.

In yet another embodiment an apparatus for controlling air flow into a burner responsive to parameter variations affecting air density is disclosed comprising: a fan motor for driving an air inlet fan of the burner; a combustion air temperature sensor for providing an electrical signal inversely proportional to air density in the vicinity of the burner to a controller; and a controller for receiving the electrical signal at a control input thereof and processing it according to a predetermined relationship to provide a fan speed drive signal from a controller output to the fan motor.

In still another embodiment an apparatus for controlling air flow into a burner for heating water responsive to parameter variations affecting air and fuel density is disclosed comprising: a fan motor for driving an air inlet fan of the burner; one or more sensing devices selected from the group consisting of a barometric pressure sensor for providing a first indicator signal to a controller, a combustion air temperature sensor for providing a second indicator signal to the controller, a fuel temperature sensor for providing a third indicator signal to the controller, and a fuel pressure sensor for providing a fourth indicator signal to the controller; and a controller for receiving one or more of the first, second, third, and fourth indicator signals at respective inputs thereto and processing them according to a predetermined relationship to provide a fan speed drive signal from a controller output to the fan motor.

DETAILED DESCRIPTION OF THE INVENTION

Figure 1:
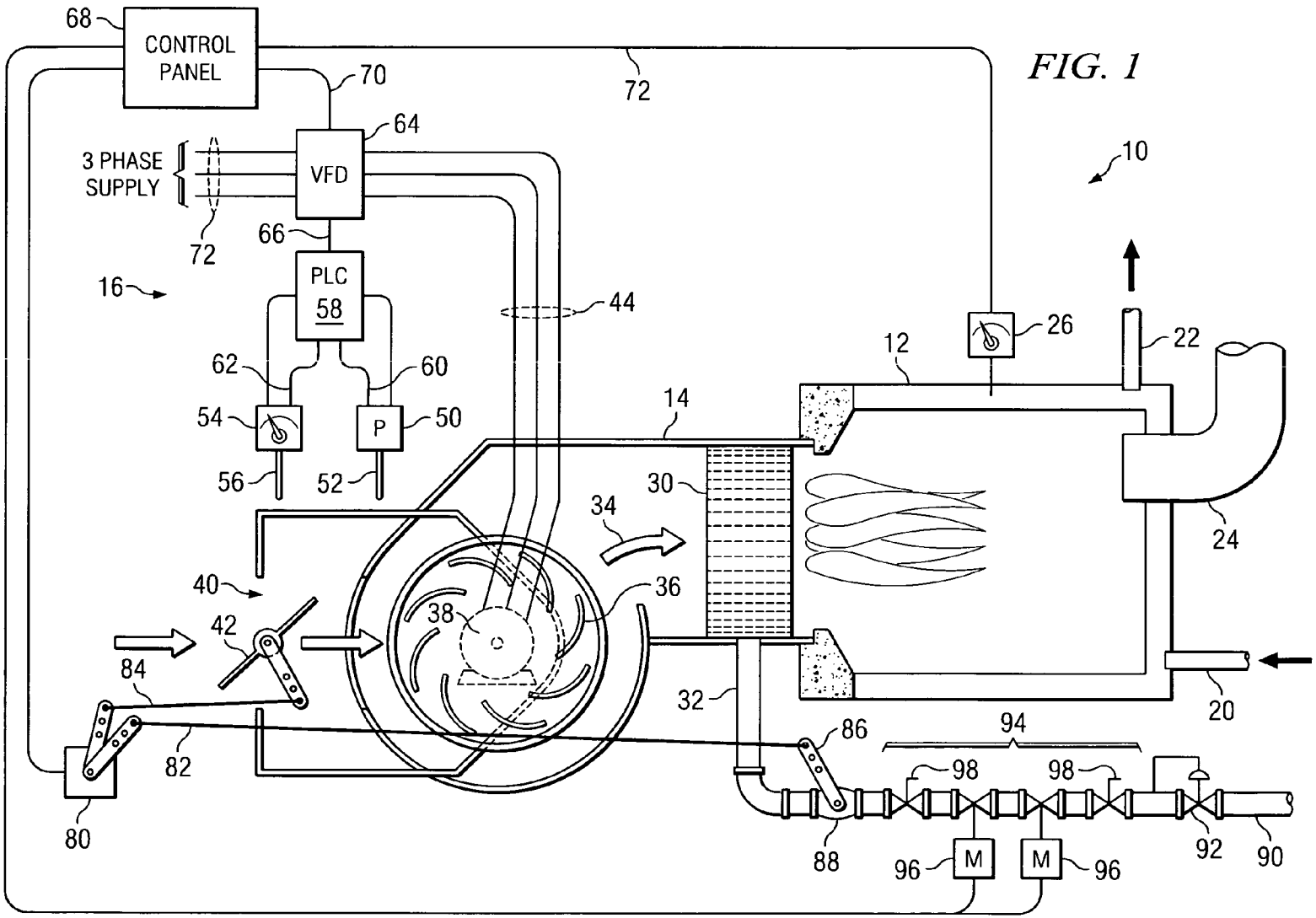
FIG. 1 illustrates a pictorial and block diagram of one embodiment of a water heater burner according to the present invention.

The embodiment of the present invention described herein is not intended to be limiting but to illustrate the principles and the application of the invention. The present embodiment applies corrections for both combustion air temperature and barometric pressure to an illustrative water heater burner system. As used in the following description, combustion air is the air inlet to the burner, whether it is the ambient air at the inlet to the burner, indoor air ducted to the burner air inlet, or outside air ducted to the burner air inlet. However, the invention may be adapted to use the correction systems individually for temperature or pressure or to either gas-fueled or oil-fueled burners, depending upon the particular application. Further, while the embodiment to be described focuses on the particular control mechanisms that may be embodied in an illustrative water heater system, the present invention is readily adaptable to burners used in other applications such as steam boilers, kilns, foundries, etc. Moreover, because the present invention provides a control mechanism that operates independently of the usual mechanisms found in the illustrative water heating systems that utilize burners, many of the structural and operating details of these usual mechanisms of the water heaters, well known to persons skilled in the art but unrelated to the present invention, are not described herein.

Regulating the operation of a burner involves the application of several well-known relationships for gases. The density of a gas D is determined by the amount of the gas per unit volume, or, mass/vol or, $D=m/V$. The Ideal Gas Law states that the volume of a gas is related to the temperature and pressure by the formula $P\times V=k\times T$, where P=pressure; V=volume, T=temperature, and k=constant. Restated, this relationship is $V=(k\times T)\div P$, or, simply $V \propto T/P$. Thus simplified, the density $D\propto m\div(T/P)$, or, $D\propto m(P/T)$. In words, density is proportional to pressure and inversely proportional to temperature. In a burner, to maintain an efficient combustion ratio, the parameter of interest is the mass flow rate of the air or the gas into the burner. Since the mass of a gas varies with its density, the mass flow rate of the gas (or air) varies with barometric pressure and inversely with ambient temperature.

The present invention described herein takes advantage of the dependence of the density of air used in a combustion mixture with a gas or oil (liquid) fuel upon the combustion air temperature and barometric (atmospheric) pressure of the air inlet to a burner for an illustrative water heater. This relationship, since it defines the effect of combustion air temperature and barometric pressure upon the mass of air and thereby the mass flow of air inlet to the burner, enables control of the air-fuel ratio, the ratio of the masses of the air and fuel, based on the outputs of combustion air temperature and barometric pressure sensors placed in the inlet side of the burner system. To say it another way, the system applies corrections to the air flow in response to variations in those attributes that would alter the mass flow rate and upset the air-fuel ratio of the mixture into the burner. The control provides correction of the air-fuel ratio for the changes in combustion air temperature and pressure that may occur during normal operation of the burner, whether the variations take place daily or seasonally. Not only is the air-fuel ratio held within more efficient limits, but the excess air is also controlled more closely to the preferred range of air-fuel ratios, providing a burner system that will have fewer maintenance problems caused by flame instability when operating at very high air-fuel ratios. The result is more reliability and a savings of fuel and energy costs provided by a more efficient burner. Moreover, because the control reduces the fan speed, it will also provide a savings of electrical energy, an inherent benefit of using a variable frequency drive ("VFD") for use with AC fan motors, or a variable speed drive ("VSD") for use with DC fan motors, that is described herein.

One important operating parameter of burners that is related to the air-fuel ratio for efficient combustion and to the stability of the combustion that occurs in the burner is called "excess air." The optimum air-fuel ratio of the masses of air and fuel flowing into the burner for efficient combustion is approximately 16 pounds of air for every pound of fuel consumed, i.e., 16 to 1. If less air is inlet to the burner for each pound of fuel, the result is lower heat output and the emission of unburned fuel, representing wasteful operation. If more than 16 pounds of air is inlet to the burner for each pound of fuel, some of the energy in the fuel is used to heat the excess air and the combustion is operating too lean, representing inefficient operation. It turns out that some small amount of excess air—e.g., 10% to 15%—is preferred to ensure complete burning of the fuel, resulting in an air-fuel ratio of approximately 18 pounds of air to one pound of fuel. Thus, a measure of the combustion efficiency is the amount of excess air that is permitted. Normally, a range of percentages, from about 10% to 30% is allowed, which accommodates a range of operating conditions such as air temperature and other parameters that affect the density of the air inlet for combustion, and ultimately, the air to fuel ratio.

One condition that can occur if the excess air becomes too large a percentage of the optimum mass flow rate of the air is called "flame instability." This occurs when there is insufficient fuel involved in the combustion process, i.e., an overly lean mixture of fuel in proportion to the available air. The resulting flame is starved for fuel, making it uneven and unstable. An unstable flame may cause the burner to "huff and puff," as it tries to adjust to the excessive amount of air, with very poor efficiency and low or intermittent heat output. In severe cases, the burner may shake with the uneven burning, possibly leading to vibration and damage to burner structure, etc.

The present invention, by fine tuning the air to fuel ratio in response to factors that affect the density of the air and, to a lesser extent, the fuel in some applications, acts to prevent instability and to maintain the excess air within a smaller range that is closer to the optimum value over a wider range of temperatures and pressures. Thus, maintaining the excess air within a narrower range results in direct energy savings and improved efficiency. The present invention, as will be apparent from the following description, is also simple, easy to adapt to existing systems, and is relatively low in cost. It also results in a smoother operating burner system and improved longevity.

The system and method of the present invention may be retrofitted to existing burners without modification to the burner components. Since the system and method involves control—i.e., electrical changes—only of the inlet air fan, it is independent of the burner hardware and thus does not involve or affect the burner itself, which operates according to its own control loop. Moreover, it is low in cost, requiring only the addition of a temperature and/or a barometric pressure sensing devices, an interface circuit or system such as a VFD system or a VSD system (also called VFDS or VSDS, respectively herein), all of which are nominal cost items, to implement the system.

The interface circuit or system receives the signals from the sensing devices and processes them according to a well-defined transfer function, producing a fan speed drive signal that varies the speed of the AC motor driving the inlet air, aka the "combustion air" fan. The fan speed drive signal may be a variable amplitude DC voltage or a variable frequency AC voltage, depending upon the type of motor used in the system. The present invention quantifies, as a percentage of flow, the change in air density caused by the changes in combustion air temperature and barometric pressure, as defined by the Ideal Gas Law. The Fan Laws state that, at a constant fan speed, the air volume provided for the combustion of the fuel will remain the same even though the density has changed, resulting in a mass flow change directly related to the density change caused by changes in combustion air temperature and barometric pressure. Further, the Fan Laws state that a change in fan speed will result in a proportional volume change. Thus, changing the fan speed the same percentage as the resulting density changes will correct the density change and provide a constant mass flow of air for combustion. For example, if the density relations indicate that the mass flow rate is reduced 3% because of an increase in temperature, the system can increase the fan speed by 3% to correct for the change in density caused by the change in temperature.

In practice, persons skilled in the art will recognize that, while the Ideal Gas Law and the Fan Laws provide the foundation of the control strategy embodied in the present invention, some minor variations in the actual flow characteristics may be noticed in real world applications. In such cases, engineering design and experimentation are relied upon to make needed adjustments or to compensate for these variations from the ideal case. The control described herein, because it is configured to affect only the fan speed, is readily adaptable to existing systems largely without affecting the control mechanisms already in place. Such mechanisms include linkage or parallel positioning systems that control the operation of valves through mechanical linkages, from those that provide a simple ON-OFF, LOW-HIGH-LOW control to those operated by multiple linkages connected to a single actuator or to those providing continuously variable control operated by a modulation motor. Actuators and modulators may be controlled by switches or electronics.

Referring to FIG. 1, a pictorial and block diagram illustrates one embodiment of a water heater system 10 according to the present invention. The water heater system 10 includes a boiler 12 and a burner system 14 controlled by a controller (or control section) 16. The illustrated boiler 12 includes a feed water inlet 20 and a heated water or steam outlet 22 and a flue gas outlet 24. A water temperature sensor 26 may be provided via a signal line 72 to a control panel 68 in the controller 16. The water in the boiler 12 is heated by a firing head 30 where combustion air and fuel are mixed and ignited. The fuel is introduced into the firing head 30 via a pipe 32. The inlet combustion air 34 is inducted via a fan 36 enclosed within the housing of the burner 14. The fan in this example is driven by a three phase, 60 Hz AC motor 38 in the illustrative water heater system 10. In similar applications, the fan motor 38 may be a DC motor. The burner system 14 includes a plenum portion having an inlet 40 controlling the air volume via a damper valve 42. The damper 42 is operated by a lever and linkage 84 connected to a modulator motor 80. The burner system 14 also includes a fuel feed system that receives fuel from a fuel supply via a pipe 90 feeding through a fuel pressure regulating valve 92, a control valve section 94, a fuel metering valve 88, and ultimately into the pipe 32 and the firing head 30. The control valve section 94 may include solenoid or motor-operated safety shut-off valves 96 and/or manual valves 98 as shown. The fuel metering valve 88 may be controlled by a lever and linkage 86 connected to the modulator motor 80. The modulator motor 80 and the valves operated by motors or solenoids 96 may receive operating control signals via lines connected to the control panel 68.

Continuing with FIG. 1, the control section 16 of the water heater system 10 will be described. The three phase, 60 Hz AC motor 38 that drives the fan 36 receives its three phase operating voltage via the lines 44 connected to a VFD 64. The VFD 64 is a variable frequency drive (VFD) that provides at its output a variable frequency, three phase AC voltage for powering the motor 38. Motor 38 may be a three phase AC motor that, when supplied its normal rated 60 Hz input, operates at its rated speed of $M_f$ 3500 revolutions per minute (rpm), driving the fan 36 to deliver an air volume regulated by the air damper 42 in cubic feet per minute into the burner system 14. Through the VFD 64, the speed of the fan 36 may be varied or, in this embodiment, slowed down from 3500 rpm by reducing the frequency of the AC voltage supplied to the motor 38 from the rated 60 Hz to some lower value. The VFD 64 in the illustrated embodiment is powered by a three phase, 60 Hz AC supply voltage via the lines indicated by the reference number 72. In alternate embodiments contemplated within the scope of the present invention, fan motors may be configured for operation on single phase AC voltage or at other nominal speeds at their rated 60 Hz inputs, such as 1750 RPM, 1120 RPM, etc. In alternate embodiments contemplated within the scope of the present invention that employ DC motors, the speed of the DC motor may be varied using a variable speed drive ("VSD") unit that varies the amplitude of the voltage to the DC operated motor. In such applications, the VSD unit would be responsive to the same control inputs from combustion air temperature sensors, barometric pressure sensors, or a programmable circuit system, as described for the system using AC motors described in detail herein.

Returning to the illustrated embodiment, the VFD is also coupled to the control panel 68 via the line 70 to enable it to be responsive to other control parameters and conditions. Line 70 is typically a cable containing numerous connections to the control panel 68. The control panel 68 controls the operations of the VFD 64 in response to a variety of conditions to provide efficient operation, save energy, and maximize the safety and reliability of the burner. The AC motor 38 may be closely controlled in start/stop, speed control, ramping up/down of the fan 36. Operating limits are also closely controlled to avoid damage or unsafe conditions. While important to the operation of the water heater and burner system, these functions of the control panel 68 are not relevant to the present invention and will not be described further herein. Thus the present invention may be implemented or retrofitted to existing equipment at nominal cost and without requiring modifications to the system other than adding several nominal cost components and changing some of the wiring.

Two sensors are provided in the controller 16 for the burner system 14 shown in FIG. 1. A barometric pressure sensor 50, including a probe 52, is installed near the burner system 14 to measure the atmospheric pressure. In addition, a combustion air temperature sensor 54, including a probe 56, is installed in a position near the damper 42 to measure the combustion air temperature. Both sensors 50, 54 provide direct current (DC) electrical outputs to be used as indicator signals corresponding to the measured values of the sensors. These outputs vary between 4 milliAmperes (mA) and 20 mA, according to industry standard practice. In the illustrated embodiment, a suitable pressure sensor is provided by a type GP311 industrial grade pressure transducer manufactured by GP:50 NY Ltd., Grand Island, N.Y. 14072, and www.GP50.com. This transducer includes the sensor and a transmitter for sending the 4-to-20 mA output signal current to the input of the PLC 58. A suitable temperature sensor is a resistance temperature device (RTD) provided by a type T91U-2-D rangeable transmitter and duct sensor manufactured by Kele Inc., Bartlett, Tenn. 38133, and www.kele.com.

The pressure and temperature sensor outputs are coupled respectively via lines 60 and 62 to a circuit or circuit system such as a PLC 58, to be processed and converted to a fan speed signal under program control. Persons skilled in the art will realize that a specially-designed circuit could be used for the circuit system at block 58. However, a programmable logic controller (PLC) is convenient because it is an off-the-shelf component that can receive multiple inputs and can be programmed for multiple outputs. Further, through its ability to respond to programmed instructions, it can apply an appropriate transfer function to the processing of the input indicator signals to produce the fan speed signal at the output of the PLC via the line 66 coupled to the VFD 64. In the illustrative example, a suitable PLC device is a Part No. HE-XE105 manufactured by Horner APG, LLC, Indianapolis, Ind. 46201, and www.heapg.com. The output of the PLC 58 may be coupled to an input of a VFD 64. The VFD 64 is a machine control to be described that is present in the AC supply circuit to the fan motor 38. In the present invention, the VFD 64 is utilized to also respond to the fan speed signal as a control input from the PLC 58 by varying the frequency of the AC voltage to change the speed of the fan motor 38. In other embodiments having only a single control input, such as either temperature or barometric pressure, that control input (sensor output) can be connected directly to the VFD 64 as long as the signal complies with the standard 4 mA to 20 mA range.

The VFD 64 is a standard off-the-shelf component that provides a control method for correcting the air-fuel combustion ratio for changes in the ambient temperature and barometric pressure. As noted herein above, the flow rate of the air 34 inlet to the firing head 30 is a direct, linear function of the speed of the fan 36 because of the fan law. The VFD 64 in this example operates from a three phase AC voltage supply via the lines 72 and includes a rectifier, a frequency inverter, and a control section as internal circuitry to regulate the frequency of the output waveforms generated by a pulse width modulator circuit in accordance with the fan speed signal from the PLC 58. These circuit elements within the VFD 64, well-understood by persons skilled in the art, will not be further described herein. The fan speed signal input to the VFD 64 from the PLC 58 may be a DC current, such as a 4 mA to 20 mA current, or it may be a DC voltage varying in the range of 0 to 10 Volts DC, for example, according to industry standard practice.

The VFD 64 generates a variable frequency AC voltage to drive the AC operated fan motor 38. The fan motor 38, which nominally operates at 3500 RPM (in this example) when the AC supply voltage is 60 Hz, may be slowed down by reducing the frequency of the AC voltage generated by the VFD 64. This variation in the AC voltage output frequency is proportional to the fan speed drive signal supplied by the PLC 58 and coupled to an input of the VFD via the line 66. The VFD is a device known in the industry as a general machinery drive. In the illustrated embodiment, the VFD may be a type ACS350 manufactured by ABB Inc., New Berlin, Wis. 53151, and www.abb.us/drives.

In an alternative embodiment that is not illustrated herein but will readily occur to persons skilled in the art, the VFD 64 may be replaced by a variable speed drive ("VSD") that provides a direct current fan speed drive voltage for controlling a DC operated fan motor. Substitution of a DC motor for an AC motor does not change the present invention, is contemplated as falling within the scope of the present invention, and is merely a functionally equivalent choice made to satisfy a particular application. Some burners for heating water, or used in other systems may utilize a DC motor as efficiently as an AC motor. In such applications, a variable speed drive or VSD is substituted for the VFD. A VSD may be configured to be responsive to a DC fan speed signal output to the VSD by the PLC.

While the present invention is illustrated herein by an embodiment having control of both the combustion air temperature and the barometric pressure, other applications may use differing embodiments, considering factors such as the following. For example, in gas burners, both the air and gas supply pressures are referenced to the barometric pressure. The inlet pressure to the fan is the atmospheric pressure, and the gas pressure regulator controls to some pressure over the atmospheric pressure. Thus, in the case of a gas burner, these two pressure effects change in the same direction, and in most cases a correction to the mass flow of the air inlet is required only for variations in the ambient temperature. However, in gas burners with a vented gas pressure regulator, a slightly modified correlation may be required because the barometric pressure change will also change the gas pressure. The correction adjustment may be made in the PLC 58 by referencing the regulated gas pressure. In the case of an oil burner, since the variations in atmospheric pressure will affect the air mass flow while the oil mass flow rate remains unchanged, a correction to the mass flow of the air inlet is required for variations in both the combustion air temperature and the atmospheric (i.e., barometric) pressure.

Figure 2:
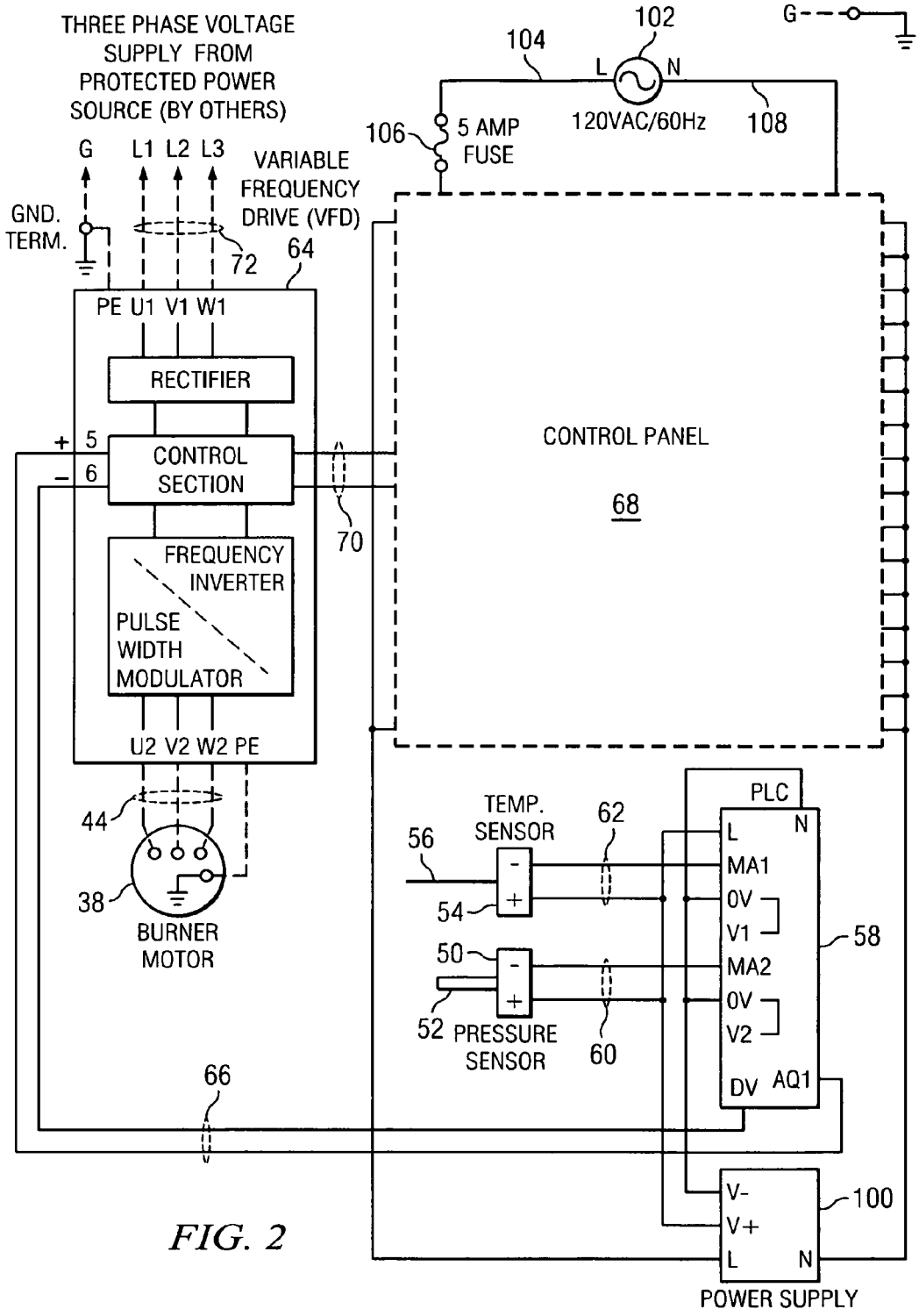
FIG. 2 illustrates a block diagram of a control portion of the one embodiment of the water heater burner of FIG. 1.

Referring to FIG. 2, there is illustrated a block diagram of the control portion of the embodiment of the water heater burner illustrated in FIG. 1. In FIG. 2 the same reference numbers are used to identify the same structures. FIG. 2 includes a motor speed controller comprising a first section (PLC 58) and a second section (variable frequency drive (VFD64)). A pressure sensor 50 and its probe 52 are shown connected through the line 60 to the PLC 58 at terminal "L" and to a power supply 100 at a terminal marked V+, and through the other side of the line 60 to a terminal labeled MA2 of the PLC 58. Similarly, a temperature sensor 54 and its probe 56 are shown connected through the line 62 to the PLC 58 at terminal "L" and to the power supply 100 at the V+terminal, and through the other side of the line 62 to a terminal labeled MA1. The PLC 58 is powered by the power supply 100 along connections from V+ and V− respectively to terminals labeled L and N. The fan speed signal output from the PLC 58 is coupled to the VFD 64 along the two wire line 66 between the PLC 58 at terminals labeled AQ1 and DV to the VFD at control terminals 5 (+) and 6 (−).

The VFD 64 is a machine control unit connected between the three phase AC supply source and the AC supply terminals of the fan motor 38. Thus, the L1 line in cable 72 connects to terminal U1 of the VFD 64 and terminal U2 of the VFD 64 connects to an L1 terminal of the fan motor 38. Similarly, line L2 from the source connects via cable 72 through terminals V1, V2 to an L2 terminal of the fan motor 38 and an L3 line in cable 72 connects through terminals W1, W2 to an L3 terminal of the fan motor 38. A ground connection from terminal PE of the VFD 64 is provided on the AC source side and a ground connection from the terminal PE on the output of the VFD 64 is provided to the frame of the fan motor 38. The cable 44 from the VFD 64 may be shielded, with the shield connected to the PE terminal of the VFD 64. The control panel 68 shown in FIG. 2 includes substantial circuitry for regulating various safety and operating functions of the water heater burner, including the fuel supply, water temperature, etc. Since the present invention provides control of the inlet air by regulating the inlet fan speed independently of the rest of the burner system, the control panel operation is not relevant to describing the operation of the present invention. The control panel is shown connected to a source 102 of 120 VAC/60 Hz power that is coupled to the control panel 68 via a line L (104) and a line N (108). The line L (104) includes a 5 Amp fuse 106.

The linear speed control characteristic provided by the VFD 64 enables a simple relationship between the variations in the sensed parameters and the speed of the fan motor 38 to be established by the control section 16. For example, in a typical application where the air temperature is expected to vary between 50° F. and 120° F., the maximum (rated) motor speed, $M_f$=3500 rpm at 60 Hz, may be set to correspond to the maximum temperature, 120° F. (where the air has the lowest density) and the minimum motor speed may be set to, for example, 3077 rpm at the 50° F. temperature of the ambient air where the air has the highest density. The speed of the fan motor 38 is held constant above 120° F. and below 50° F., and varies linearly between these two temperatures. These limits are typically determined by factory settings. The factory settings cover all the expected temperatures of operation, the fuel input rate and the amount of air required to completely and efficiently burn all of the fuel, and standard temperature and barometric pressure for the region where the system will be operating. An example of the calculation to determine the speed of the fan motor 38 at 50° F. follows.

Consider the application where the air temperature varies from 120° F. (condition 1) to 50° F. (condition 2), and the normal barometric pressure is 28.7" Hg. We will use several standard values and relations in the following calculations. They are:

Density=weight of gas per volume of gas (lb/ft$^3$ of gas at the stated pressure and temperature);

Std. density=density of the gas at standard conditions (0.0765 lb/ft$^3$ for air at 60° F. and 29.92" Hg);

Absolute pressure=gauge pressure+barometric pressure of the current condition;

Std pressure=standard pressure, 29.92" Hg (barometric pressure);

Std temperature=standard temperature, 60° F.; and

Absolute temperature=460+° F. of the gas.

Based on the known fuel input, the burner requires 10,000 pounds per hour of air to completely and efficiently burner all of the fuel provided by the burner. The following analysis would be used to generate the control strategy.

The densities of the air at the two conditions are (from Eqn. 1);

Density 1=0.0765×(28.7/29.92)×(460+60)/(460+120)= 0.06579 lb/cuft

Density 2=0.0765×(28.7/29.92)×(460+60)/(460+50)= 0.07482 lb/cuft

The required fan output for each condition will be, using

Fan Actual Cubic Feet per Minute (ACFM)= (lb air/hr)/(density×60 min/hr) {Eqn. 2)

ACFM1=10,000/(0.06579×60)=2533 CFM

ACFM2=10,000/(0.07482×60)=2228 CFM

Where the values are;

Lb air/hr=pounds of air required per hour (as stated in this example);

Standard air density=0.0765 lb/ft$^3$;

Standard air pressure=29.92" Hg;

Local air pressure=28.7" Hg;

Air temperature at condition 1=120° F.;

Air temperature at condition 2=50° F.; and

RPM=revolutions per minute.

The burner was setup under condition #1 at 120° F., which is the lowest air density. The combustion air motor and fan are operating at 3500 RPM and the air damper is adjusted to generate a flow of 2533 CFM, which provided enough air to completely burn the fuel and some minimal amount of excess air, for good combustion efficiency.

At condition #2, the fan will generate the same volume of air (based on fan laws), and since the density is much higher (more pounds of air per volume at this lower air temperature) the burner would normally have much more air then needed for combustion. A higher excess air rate would result in lower combustion efficiency. The system of the present invention will change the fan speed to match the changes in air temperature, and provide the same mass of air to the burner firing head 30. The new fan speed required to obtain a volume flow of 2228 CFM is, $$RPM2 = (RPM1)\times(ACFM2/ACFM1) \quad \text{\{Eqn. 3\}}$$

$$= (3500\,RPM)\times(2228/2533)$$

$$= 3077\,RPM$$

Where,

RPM1=RPM at condition 1, and RPM2=RPM at condition 2.

The foregoing example illustrates an application of the present invention to a water heater burner system wherein the combustion air temperature alone is used as a control parameter to vary the speed of the fan motor 38. This example is simple and low cost, making it especially adaptable to smaller burners with lower fuel costs and lower payback opportunity. In this application, the PLC is not needed because the 4 to 20 mA analog control input to the VFD 64 is available. The VFD device generally has this capability through its built-in single loop controller to convert the DC control input to the fan speed control signal. This particular embodiment thus does not require any programming and would be transparent to the start-up technician and in use. Persons skilled in the art will readily be able to adapt the invention to their specific system based on the description provided in the foregoing example.

Other applications of the present invention include a simple pressure control package for burners that again utilizes the single loop controller of the VFD 64 and a barometric sensor such as the sensor 50 and probe 52 combination described herein above. The process for configuring the system is similar, based on initial conditions defined for two different air densities and the corresponding fan outputs ($ACFM_1$ and $ACFM_2$) calculated from: (amount of air required, in lb., for the given amount of fuel)÷(air density, in lb./cu. ft.) for each of the two conditions. For a hypothetical atmospheric pressure range of 27.7 in. (condition 1) to 29.7 in. (condition 2), a temperature of 85° F. and 10,000 lb. of air required to burn the fuel, $ACFM_1$=2466 CFM and $ACFM_2$=2300 CFM. At condition 1, the RPM, is set to 3500 RPM for apressure of 29.7 in. Then $RPM_2$ is determined by: $RPM_2$=3500 (2300÷2466)=3264 RPM. Notice in this example that the highest fan speed is set to the lower pressure boundary, where the density of the air is lower. As the pressure rises, the density of the air increases, and the fan speed necessary to maintain the correct CFM must be reduced.

In another application of the present invention for water heaters, both combustion air temperature and barometric pressure corrections can be implemented. The system is much like the illustrated embodiment described herein above. From the previous examples of single control elements, the correction for air temperature and pressure has been defined. They can be combined in the following manner, wherein the calculations are performed in the PLC responsive to inputs from both types of sensors. Correction factors for the ambient air temperature and the barometric pressure are defined as follows:

$$K_T=(460+T\text{air})/(460+T\text{max}); \text{ and}$$

$$K_P=Bp\text{low}/BP\text{air}.$$

Thus, the fan speed is determined by:

$$\text{Speed}=3500\ \text{RPM}\times K_T\times K_P,$$

Where, $K_T$=Temperature correction factor (dimensionless);

$K_P$=Barometric pressure correction factor (dimensionless);

$BP_{air}$=current barometric pressure, Hg, in.;

$BP_{low}$=lowest barometric pressure, Hg, in.;

Tair=current air temperature, ° F.;

Tairmax=the highest expected combustion air temperature ° F.; and

Speed=controlled RPM of the combustion air fan motor.

These calculations provide a set of relationships—which may be represented by a family of characteristic curves, if plotted (i.e., one curve for each increment of barometric pressure, when the axes are motor speed vs. combustion air)—where the different barometric pressures would be identified with multiple lines. These operations would be performed on a continuous manner, where the fan speed drive signal is always calculated and delivered to the VFD, and the fan always operates at the correct speed for the operating conditions. When the unit is initially setup, it will be calibrated to the correct mass flow, as measured by a combustion analysis performed at startup.

The foregoing are just a few of the examples of combustion control through applying measurements of temperature and pressure of the ingredients of the combustion process. Other potential applications include controls based on: gas fuel temperature; combined fuel temperature, combustion air temperature and barometric pressure; and outside ducted combustion air temperature. Any combination of combustion air temperatures, barometric pressure, gas fuel temperature and gas fuel pressure can be used by applying the Ideal Gas Law and the Fan Laws.

The present invention may even be used to correct the fan speed in a burner system that already uses a variable speed control to maintain a constant pressure at the air inlet of the burner, between the air damper and the fan. In such a variable motor speed control system, a pressure sensor is located between the air damper and fan inlet to measure the pressure at that location. A single loop controller reads this pressure and is programmed to maintain a constant pressure, typically around −2.0" w.c. (inches of water columr). Note, for reference, 27.7" w.c. in a tube=1.0 pounds per square inch ("psi"). As the air damper opens, the pressure drops, and the control will increase the fan motor speed to maintain the set pressure. As the air damper opens, increasing the air supply to the burner, the firing rate is allowed to increase. If the air damper is located on the outlet side of the fan, the pressure will be positive instead of negative. This system has been used in many applications over the years. Typically, the motor will vary from about 1000 RPM at low fire up to 3500 RPM at high fire. The electrical use at the lower firing rates is considerably lower than the standard burner, and results in a significant electrical savings. Rebates from electric companies may be available for these applications.

In some applications, known as so-called "true variable speed systems," where the fan speed is controlled over a large speed range, e.g., 1000 RPM to 3500 RPM, control based on temperature offers true savings. This is also true for combined sensing, such as temperature and pressure, yielding improved efficiency and savings. The present invention is primarily directed to and contemplated for use with systems in which substantial gains in efficiency can be realized by varying the fan motor speed over a narrower range, such as 2800 to 3500 RPM. Nevertheless, the principles of the present invention may readily be applied to control of the wider range of speeds, with corresponding improvements in efficiency and reduced operating costs.

To combine the electrical savings of the standard variable speed motor control with, for example, the air temperature control of the illustrated embodiment described herein above, the application of the air temperature adjustment would be accomplished using a "square law" that says the ratio of pressures equals the ratio of the flows squared, or $$P_2=P_1\times(ACFM_2+ACFM_1)^2 \quad \{Eqn. 5\}$$

Where, $P_2$=New pressure set point between the air damper and fan;

$P_1$=Original pressure set point between the air damper and fan, −2.0" wc;

$ACFM_1$=air flow rate before temperature change; and $ACFM_2$=air flow rate required after temperature changes.

The ratio of old to new air flow is represents the volume air flow rate change required to maintain the same mass flow rate of the burner, which can be determined directly from the temperature change as done in the described embodiment, with the final form of:

$$P_2=P_1\times(460+T\text{air})/(460+T\text{airmax}) \quad \{Eqn. 6\}$$

Where,

Tair=current air temperature, ° F.;

Tairmax=the highest expected combustion air temperature ° F.;

Maximum air temperature=maximum expected air temperature ° F.; and

Absolute temperature of air=(460+air temperature ° F.).

A PLC is required to combine the readings of the pressure sensor and offset according the above (equation 6). This would be converted to a 4-20 mA signal that can be used by the single loop controller in the VFD, which will vary the combustion air motor speed to maintain the desired set point pressure.

While the invention is described in only several of its forms, it is not thus limited but is susceptible to various changes and modifications without departing from the spirit thereof. In the illustrative example, the control system is an electrical or electronic device, which is a typical implementation of machine control systems. In some electrically-based systems, substitutions may be made. For example, the PLC and/or the VFD or VSD may be replaced by a circuit specifically designed to process the sensor outputs and generate the particular kind of control or "fan speed signal." Further, other systems may be more amenable to control systems based on hydraulic or pneumatic circuits for sensing operating parameters and generating corresponding outputs to maintain the mass flow rate of air inlet to a burner within an optimum range for high efficiency. In other systems, the control outputs may be derived from sensors that detect variations in fuel parameters and adjust the inlet air flow to maintain a predetermined combustion efficiency and performance.

What is claimed is:

1. For use with a burner system having an air inlet and an air inlet fan driven by a variable speed motor, an inlet air density adjustment device, comprising:

a barometric pressure sensor disposed near said air inlet for detecting minor daily or seasonal variations in atmospheric pressure near said air inlet and providing a signal proportional thereto; and a motor speed controller having a first section for converting said signal from said barometric pressure sensor according to a first relationship $K_P=P_B(\text{min})\div P_B(\text{air})$, where $P_B(\text{min})$=minimum barometric pressure, and $P_B(\text{air})$=current barometric pressure measured near said air inlet of said burner system to a first electrical signal and a second section for converting said first electrical signal to a variable frequency AC voltage signal according to a second relationship $S=K_P\times M_f$ rpm, where S=speed of said motor, $M_f$=speed of said motor at 60 Hz, and rpm=revolutions per minute; and a cable connecting said AC voltage signal from said second section to AC terminals of said motor for adjusting said speed of said variable speed motor corresponding to said minor daily or seasonal variations in atmospheric pressure, thereby adjusting for variations in said inlet air density.

2. The device of claim 1, wherein:

said first section is a programmable logic controller (PLC) having at least a first input for receiving said first electrical signal; and said second section is a variable frequency drive system that includes a frequency inverter circuit and a pulse width modulator circuit.

3. The device of claim 1, further comprising:

a transfer function formed of first and second relationships and embedded in said motor speed controller that is operable to convert a percentage change in said inlet air density corresponding to said barometric pressure sensor output to an equivalent percentage change in said speed of said variable speed motor.

4. For use with a burner system having an air inlet and an air inlet fan driven by a variable speed motor, an inlet air density adjustment device, comprising:

an air temperature sensor disposed near said air inlet for detecting minor daily or seasonal variations in air temperature near said air inlet and providing a signal proportional thereto; and a motor speed controller having a first section for converting said signal from said temperature sensor according to a first relationship $K_T=(460+T(air))\div(460+T(max))$, where T(air)=current air temperature, and T(max)=maximum air temperature measured near said air inlet of said burner system to a first electrical signal and a second section for converting said first electrical signal to a variable frequency AC voltage signal according, to a second relationship $S_T=K_T\times M_f$ rpm, where $S_T$=speed of said motor, $M_f$=speed of said motor at 60 Hz, and rpm revolutions per minute; and a cable connecting said AC voltage signal from said second section to AC terminals of said motor for adjusting said speed of said variable speed motor corresponding to said minor daily or seasonal variations in air temperature, thereby adjusting, for variations in said inlet air density.

5. The device of claim 4, wherein:

said first section is a programmable logic controller (PLC) having at least a first input for receiving said first electrical signal; and said second section is a variable frequency drive system that includes a frequency inverter circuit and a pulse width modulator circuit.

6. The device of claim 4, further comprising:

a transfer function formed of first and second relationships and embedded in said motor speed controller that is operable to convert a percentage change in said inlet air density corresponding to said temperature sensor output to an equivalent percentage change in said speed of said variable speed motor.

7. For use with a burner system having an air inlet and an air inlet fan driven by a variable speed motor, an inlet air density adjustment device comprising:

a barometric pressure sensor disposed near said air inlet for detecting said minor daily or seasonal variations in atmospheric pressure near said air inlet providing a first signal proportional thereto;

an air temperature sensor disposed near said air inlet for detecting said minor daily or seasonal variations in air temperature near said air inlet providing a second signal proportional thereto; and a motor speed controller for adjusting the speed of said variable speed motor corresponding to said minor daily or seasonal variations in said atmospheric pressure and temperature, thereby adjusting for variations in said inlet air density; wherein said motor speed controller further comprises:

a first section for receiving said respective first and second signals from said barometric pressure and air temperature sensor outputs and converting them according to respective first relationships to respective first and second electrical signals;

a second section for receiving said respective first and second electrical signals from said first section and converting them to an variable frequency AC voltage signal according to respective second relationships; and a cable connecting said AC voltage signal from said second section to AC terminals of said motor to adjust the speed of said variable speed motor corresponding to said minor daily or seasonal variations in atmospheric pressure, thereby adjusting for variations in said inlet air density.

8. The device of claim 7, wherein said first relationships comprise $K_P=P_B(min)\div P_B(air)$, where $P_B(min)$=minimum barometric pressure, and P(air) current barometric pressure measured near said air inlet of said burner system, and $K_T=(460+T(air))\div(460+T(max))$, where T(air)=current air temperature, and T(max)=maximum air temperature measured near said air inlet of said burner system; and said second relationships comprise $S_P=K_P\times M_f$ rpm, and $S_T=K_T\times M_f$ rpm where $S_P$ and $S_T$ respectively=speed of said motor and $M_f$=speed of said motor at 60 Hz, and rpm revolutions per minute.

9. The device of claim 7, further comprising:

a transfer function formed of said first and second respective relationships and embedded in said motor speed controller that is operable to convert a percentage change in said inlet air density corresponding to said barometric pressure and air temperature sensor outputs to an equivalent percentage change in said speed of said variable speed motor.

10. For use with a burner system having an air inlet and an air inlet fan driven by a variable speed motor, an inlet air density adjustment device, comprising:

a sensor disposed near said air inlet and providing a signal proportional to at least one of barometric pressure and air temperature at an output of said sensor;

a motor speed controller coupled at an output thereof to AC voltage terminals of said motor and having an input of said controller coupled to said output of said sensor;

a cable connecting a variable frequency AC voltage signal from said output of said controller to said AC voltage terminals of said motor and a transfer function embedded in said motor speed controller that is operable according to a first relationship (ratio of a reference barometric pressure or air temperature and a current value near said air inlet) and a second relationship (product of said ratio and rated motor speed) calculated respectively in first and second sections of said motor speed controller to convert a percentage change in said inlet air density corresponding to an output of said sensor to an equivalent percentage change in said speed of said variable speed motor, thereby correcting said air inlet density for minor daily and seasonal variations in an atmospheric, condition sensed by said sensor.

* * * * *